US010287051B2

(12) United States Patent
Chai

(10) Patent No.: US 10,287,051 B2
(45) Date of Patent: May 14, 2019

(54) LINERLESS LABEL PRINTER

(71) Applicant: SHANGHAI MAXIM GARMENT ACCESSORIES CO., LTD., Shanghai (CN)

(72) Inventor: Robert Chai, Santa Ana, CA (US)

( * ) Notice: Subject to any disclaimer, the term of this patent is extended or adjusted under 35 U.S.C. 154(b) by 146 days.

(21) Appl. No.: 15/503,719

(22) PCT Filed: Oct. 12, 2015

(86) PCT No.: PCT/CN2015/091774
§ 371 (c)(1),
(2) Date: Feb. 14, 2017

(87) PCT Pub. No.: WO2016/197495
PCT Pub. Date: Dec. 15, 2016

(65) Prior Publication Data

US 2017/0267389 A1 Sep. 21, 2017

(30) Foreign Application Priority Data

Jun. 9, 2015 (CN) ..... 2015 1 0314047

(51) Int. Cl.
*B65C 9/22* (2006.01)
*B41J 3/407* (2006.01)
*B41J 11/70* (2006.01)

(52) U.S. Cl.
CPC ..... *B65C 9/22* (2013.01); *B41J 3/4075* (2013.01); *B41J 11/703* (2013.01)

(58) Field of Classification Search
CPC ..... B65C 9/22; B41J 3/4075; B41J 11/703
See application file for complete search history.

(56) References Cited

FOREIGN PATENT DOCUMENTS

| | | |
|---|---|---|
| CN | 202574744 | * 12/2012 |
| CN | 202704044 | * 1/2013 |
| CN | 202807218 | * 3/2013 |

* cited by examiner

*Primary Examiner* — Mark A Osele
*Assistant Examiner* — Christopher C Caillouet
(74) *Attorney, Agent, or Firm* — Prakash Nama; Global IP Services, PLLC

(57) ABSTRACT

A linerless label printer having a printing module (100); a cutting module (200) and a water application module (300) are sequentially arranged so that the cutting module (200) is provided in front of the printing module (100), the water application module (300) is provided in front of the cutting module (200); the water application module (300) comprises a shell (301) for storing water, a water application piece (303) fixed on the shell (301) and capable of obtaining water in the shell (301) to maintain moisture; the water application piece (303) comprises a water application surface (304) exposed out of an upper surface of the shell (301); a label press (302) is provided above the water application surface (304) of the water application piece (303); the water application piece is a PVA water absorption sponge. The linerless label printer has the advantages of simple structure, easy installation, as well as stable water application performance.

8 Claims, 7 Drawing Sheets

LINERLESS LABEL PRINTER

BACKGROUND OF THE INVENTION

The present invention relates to the technical field of printer devices, and more specifically relates to a linerless label printer.

Nowadays, the market provides a kind of linerless label which has a hydrophilic adhesive layer at its back. Adhesion property of the hydrophilic adhesive layer is activated once the hydrophilic adhesive layer contacts with water. Therefore, this kind of linerless label has an advantage of reduced cost over a self-adhesive label.

In the prior art, many portable label printers can be used for printing linerless labels and automatically cut a label to a required size once the label is printed so as to achieve immediate printing and labelling. However, after a linerless label is printed, water must be applied to the hydrophilic adhesive layer to activate its adhesive property. Due to complicated movements involved in applying water to the hydrophilic adhesive layer, the linerless label is severely limited with respect to its scope of application.

In view of the above, the Applicant of the present invention has another invention disclosed in CN102615999A titled "A portable linerless label printer". The portable linerless label printer disclosed in said publication comprises a printing module and a cutting module in front of the printing module, wherein a water application module is positioned in front of the cutting module; the water application module comprises a water container and a water absorptive water application piece disposed at an upper part in the water container; an upper surface of the water application piece is exposed from an upper surface of the water container, a label press is provided on the upper surface of the water container at a position above the water application piece; a gap is provided between the label press and the water application piece for labels to pass through; a water tank is provided at an inner bottom part of the water container; a water pump is provided in the water tank; the water pump is connected with the water application piece via a pipe. This kind of portable linerless label printer achieves automatic water application on the hydrophilic adhesive layer at the back of a linerless label and automatic cutting of the label after the label is printed. Therefore, such prior art linerless label printer integrates the functions of printing, water application and cutting, thereby facilitating the use of linerless labels across a wide range of applications. In order that the water application piece has good water absorption property and good water conductivity, the water application piece in the disclosed Chinese application is designed to have a foam piece at the lower part and multiple layers of non-woven fabrics at the upper part. A water application piece with this kind of complicated structure increases the difficulty of installation; also, after a long period of use, it is possible that the non-woven fabrics and the foam piece may not be always tightly connected with each other; separation between the non-woven fabrics and the foam piece causes deterioration of water application performance of the water application piece.

BRIEF SUMMARY OF THE INVENTION

In view of the aforesaid disadvantages now present in the prior art, the present invention provides a linerless label printer having a water application piece which is structurally simple and which can maintain stable water application performance.

To attain the above objects, the present invention has the following technical scheme:

A linerless label printer, comprising a printing module; a cutting module and a water application module are sequentially arranged wherein the cutting module is provided in front of the printing module, and the water application module is provided in front of the cutting module; the water application module comprises a shell for storing water, a water application piece fixed on the shell and capable of obtaining water in the shell to maintain moisture; the water application piece comprises a water application surface exposed out of an upper surface of the shell; a label press is provided above the water application surface of the water application piece; the linerless label printer is characterized in that, the water application piece is a polyvinyl alcohol (PVA) water absorption sponge.

In a preferred embodiment of the present invention, the PVA water absorption sponge is made in a sheet shape, and at least one end of the PVA water absorption sponge extends downward till a bottom part of a water trough provided inside the shell.

In an embodiment of the present invention, the shell has the water trough provided inside wherein an upper part of the water trough is provided with an opening; the shell also comprises a lower cover plate at the opening of the water trough, and an upper cover plate above the lower cover plate; the lower cover plate is provided with two slots parallel with each other; in between the two slots, a support plate is provided; two ends of the PVA water absorption sponge are inserted into the water trough through the two slots respectively such that the support plate supports the PVA water absorption sponge; a window is provided on the upper cover plate at a position corresponding to the support plate; an upper surface of a portion of the PVA water absorption sponge supported by the support plate forms the water application surface; the water application surface is positioned in the window, and is slightly higher than an upper surface of the upper cover plate.

Ribs mutually spaced with respect to one another are distributed on the upper surface of the upper cover plate in front of the window; the ribs extend toward a direction consistent with a moving direction of the linerless label. The purpose of providing the ribs is to facilitate the linerless label to pass over the upper surface of the upper cover plate by reducing the friction between the linerless label and the upper cover plate as the linerless label passes over the upper surface of the upper cover plate.

The label press is formed by a support tray and multiple roller balls; a gap is provided between a lower surface of the support tray and the water application surface of the PVA water absorption sponge; support legs mutually spaced with respect to one another are provided on the support tray to support the roller balls while allowing the roller balls to partially protrude downward and out of a lower surface of the support tray, such that when the linerless label passes through the gap, the roller balls press a hydrophilic adhesive layer of the linerless label against the water application surface for mutual contact between the hydrophilic adhesive layer and the water application surface.

To prevent the roller balls from dropping off and to prevent dust from entering into the support tray, a tray cover is provided on the support tray according to an embodiment of the present invention.

In order that the label will not be jammed within gaps between various components, an eaves board is extended out of a lower edge of a label passage of the cutting module; a frontal edge of the eaves board is provided with a blade edge attaching to the water application surface behind the roller balls; a guiding surface extending into an interior of the label passage of the cutting module and tilting upward is also provided at a rear edge of a lower surface of the support tray; the guiding surface and the eaves board form a gradually narrowed down guiding entrance from the label passage to the water application surface. According to the above structures, the linerless label can move over to the water application surface more easily.

To facilitate installation of the water application module onto the cutting module, a rear surface of the water trough is provided with at least two elongated L-shaped inserts extending along a vertical direction; each of the L-shaped inserts is formed by a root portion and a locking portion; the two elongated L-shaped inserts face toward a same direction; elongated insertion slots for insertion by the elongated L-shaped inserts are provided on a front surface of the cutting module; at least one pair of magnetic components are also provided; in each pair of magnetic components, a first magnetic component of the magnetic components is embedded inside the rear surface of the water trough next to the locking portion of a corresponding elongated L-shaped insert, a second magnetic component of the magnetic components is embedded inside the front surface of the cutting module next to a side of a corresponding elongated slot that corresponds to the corresponding locking portion. Therefore, due to magnetic attraction between each pair of magnetic components, when the elongated L-shaped inserts are inserted into the elongated insertion slots, the elongated L-shaped inserts will cause the water application module to move automatically toward a direction which the locking portions face, so that the locking portions can lock on edges of the elongated insertion slots to securely connect the water application module with the cutting module.

According to the above technical solution, the present invention uses a PVA water absorption sponge made in a sheet shape as a water application piece. Due to good water absorption property and good water conductivity of the PVA water absorption sponge, water in the water trough can be smoothly transmitted to the exposed portion of the sponge for applying water to the hydrophilic adhesive layer of a label as the label passes over the sponge, thereby activating the adhesiveness of the hydrophilic adhesive layer.

In another embodiment of the present invention, the PVA water absorption sponge is made as a block; the bottom part of the shell comprises a water pump; the water pump and the PVA water absorption sponge are connected via a pipe.

In still another embodiment of the present invention, the PVA water absorption sponge is made as a block; the bottom part of the shell is provided with a mist dispenser which has a nozzle facing toward the PVA water absorption sponge.

In the present invention, due to good water absorption property and good water conductivity of the PVA water absorption sponge, the use of the PVA water absorption sponge directly as a water application piece allows simple structure and easy installation of the printer as well as stable water application performance.

BRIEF DESCRIPTION OF THE DRAWINGS

The present invention will be further described below with reference to the drawings and some embodiments.

DETAILED DESCRIPTION OF THE INVENTION

Figure 1:
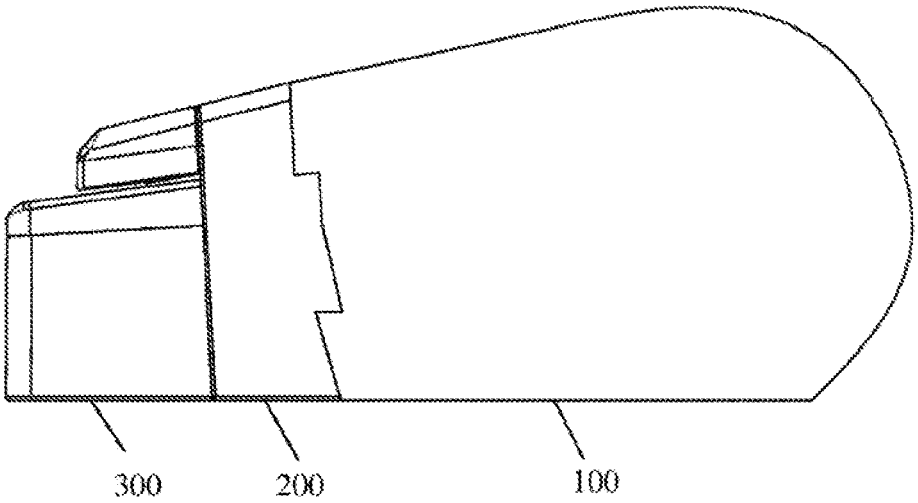
FIG. 1 is a structural view of embodiment 1 of the present invention.

As shown in FIG. 1, the present invention provides a linerless label printer which does not require additional active force to apply water to the label. The linerless label printer comprises a printing module 100, a cutting module 200, and a water application module 300.

The cutting module 200 is installed in front of the printing module 100; the water application module 300 is installed in front of the cutting module 200; the printing module, the cutting module and the water application module are integrated together.

Figure 2:
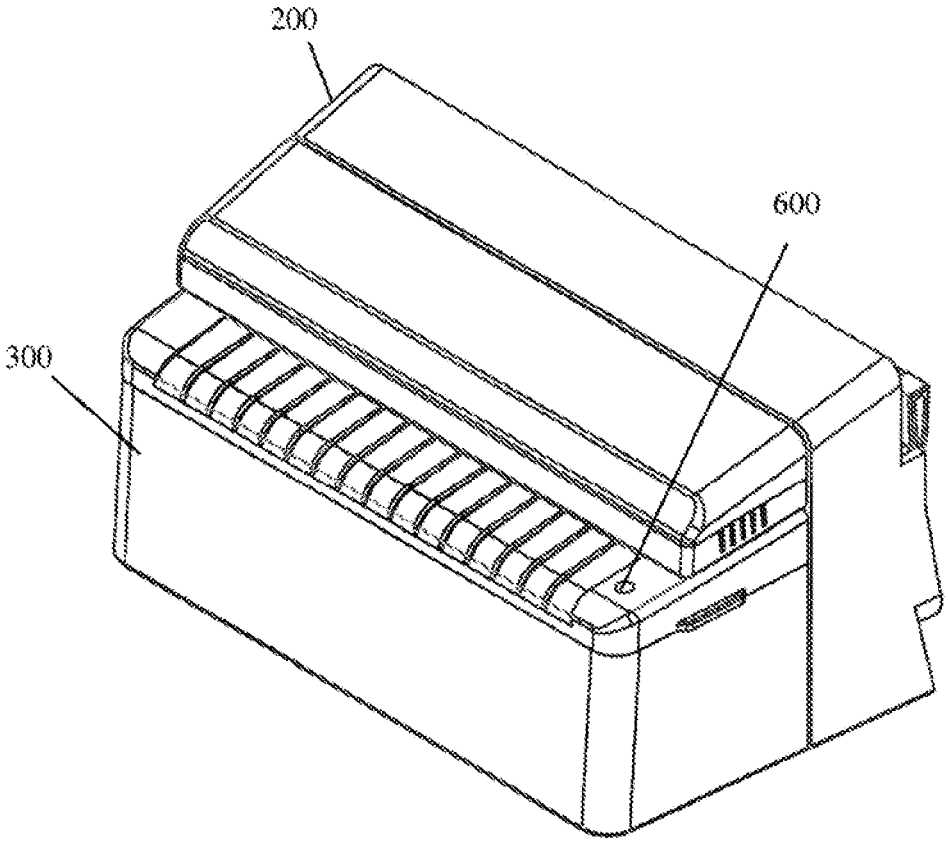
FIG. 2 is a perspective view of embodiment 1 of the present invention with the printing module omitted.
Figure 3:
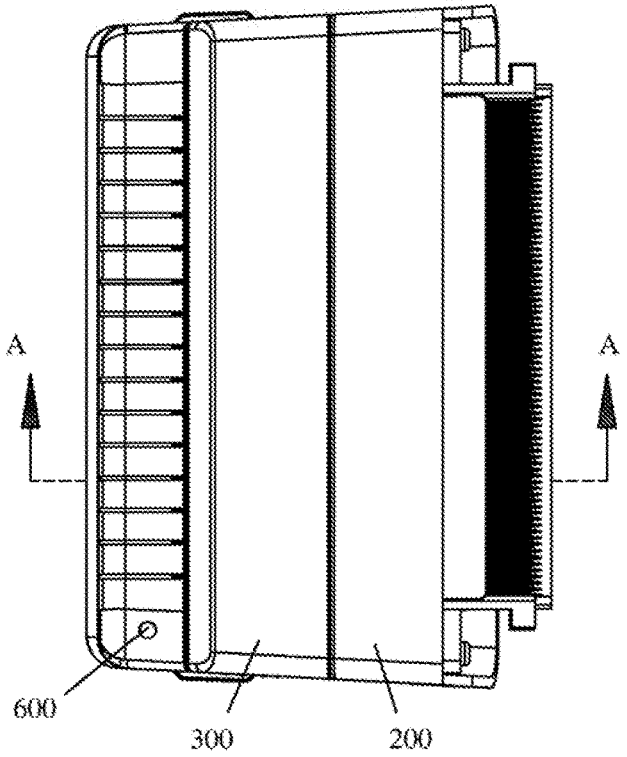
FIG. 3 is a top plan view of embodiment 1 of the present invention with the printing module omitted.
Figure 4:
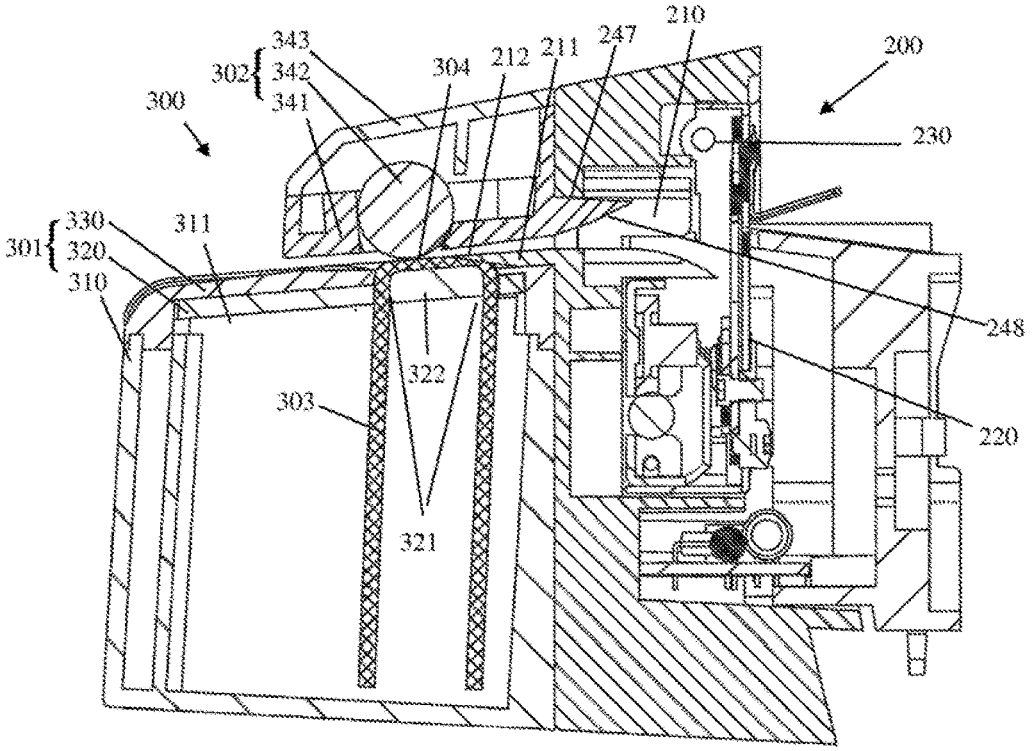
FIG. 4 is a sectional view along A-A shown in FIG. 3.

As shown in FIGS. 2-4, the water application module 300 comprises a shell 301, a label press 302, a water application piece made by a piece of polyvinyl alcohol (PVA) water absorption sponge 303; the PVA water absorption sponge 303 is made into a sheet shape having a thickness of 1.5-2.5 mm. In the present invention, the PVA water absorption sponge is preferably 2 mm thick and has a shape of a long rectangle.

The shell 301 is formed by a water trough 310, a lower cover plate 320, and an upper cover plate 330.

Figure 5:
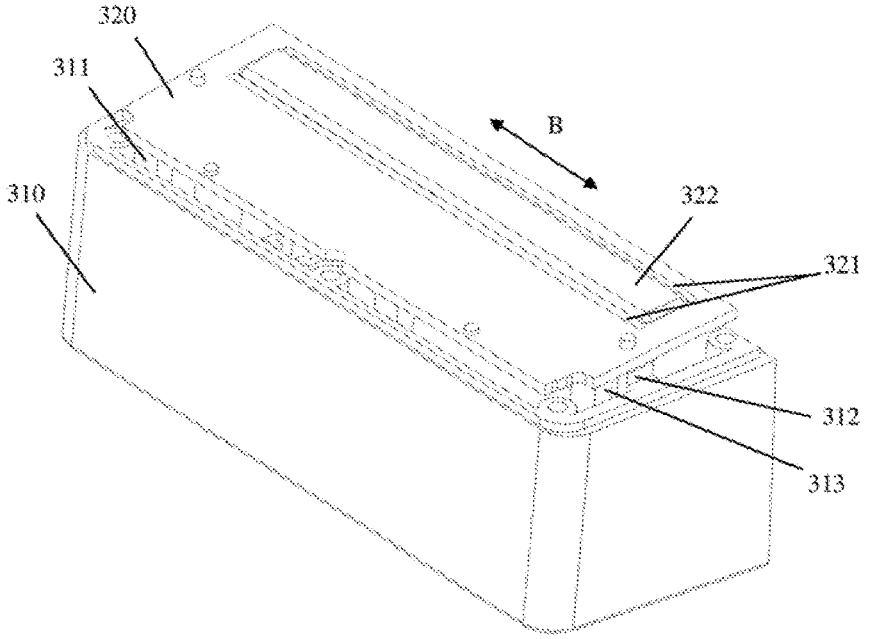
FIG. 5 is a schematic view showing the lower cover plate installed on the water trough.

With reference to FIGS. 4-5, an upper part of the water trough 310 has an opening 311; the lower cover plate 320 partially covers the opening 311 of the water trough and does not completely seal the opening 311 of the water trough 310; the lower cover plate 320 is supported by multiple supporters 312 distributed along inner edges of the opening 311; a gap 313 exist between edges of the lower cover plate 320 and peripheral edges of the opening 311 of the water trough 310.

A rear half portion of the lower cover plate 320 is provided with two slots 321 parallel and mutually spaced with each other; the two slots 321 run along a width direction B (a direction perpendicular to the moving direction of the labels). In between the two slots 321, a support plate 322 which has an upper surface positioned higher than an upper surface of the lower cover plate 320 is provided.

Figure 6:
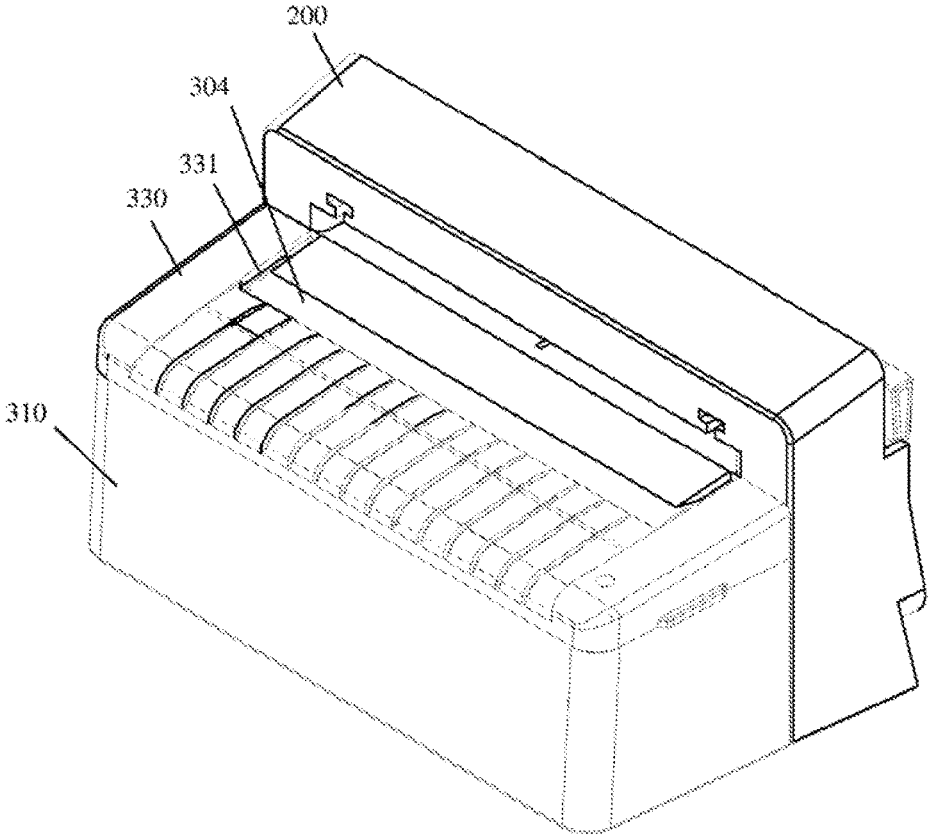
FIG. 6 is a perspective view of embodiment 1 of the present invention shown in FIG. 2 with the label press being omitted.
Figure 7:
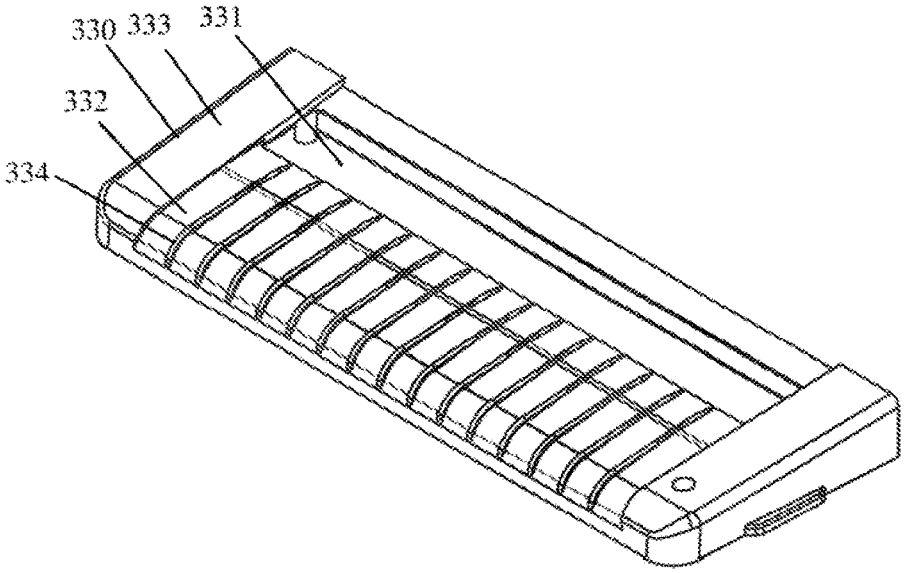
FIG. 7 is a structural view of the upper cover plate.

With reference to FIGS. 6-7, the upper cover plate 330 covers the lower cover plate 320; edges of the upper cover plate 330 join the edges of the opening 311 of the water trough 310 to seal the lower cover plate 320 inside; an upper surface 332 of the upper cover plate 330 is sloped wherein a front portion of the upper surface is lower than a rear portion of the upper surface; a window 331 is provided on the upper cover plate 330 at a position corresponding to the support plate 322 of the lower cover plate; a blocking edge 333 having a surface slightly positioned higher than the upper surface 332 of the upper cover plate is provided on each of two sides of the window 331 of the upper cover plate 330.

With reference to FIG. 4, two ends of the PVA water absorption sponge 303 are inserted into the water trough 310 through the two slots 321 of the lower cover plate respectively and extended down till a bottom part of the water trough; the support plate 322 supports the PVA water absorption sponge 303 so that a small portion of the PVA water absorption sponge 303 is positioned within the window 331 of the upper cover plate 330; an upper surface of the small portion of the PVA water absorption sponge 303 forms a water application surface 304 exposed through the window 331; the water application surface 304 is slightly higher than the upper surface of the upper cover plate 330 by 0.3-0.7 mm, preferably 0.5 mm as in the current embodiment.

In order to reduce friction at a label when the label passes over the upper surface of the upper cover plate 330, ribs 334 mutually spaced with respect to one another are distributed on the upper surface of the upper cover plate 330 in front of the window; the ribs 334 extend toward a direction consistent with the moving direction of the labels.

Figure 8:
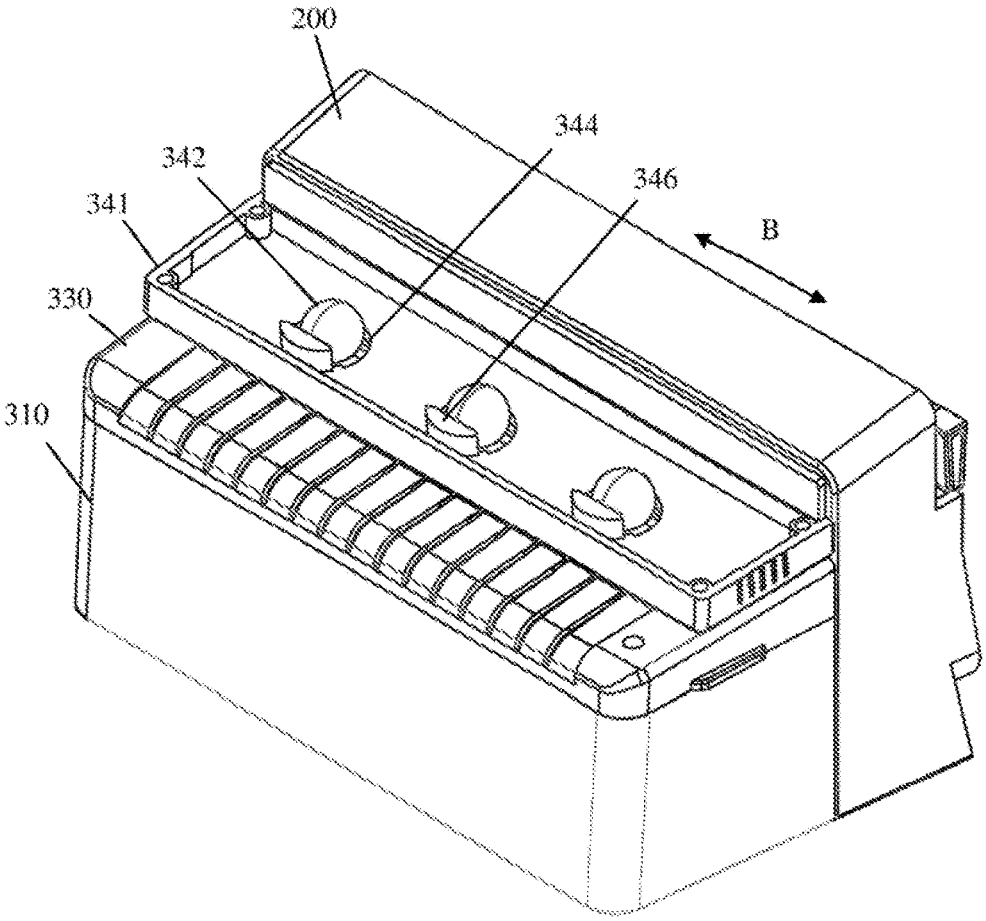
FIG. 8 is a perspective view shown in FIG. 2 with the tray cover omitted.
Figure 9:
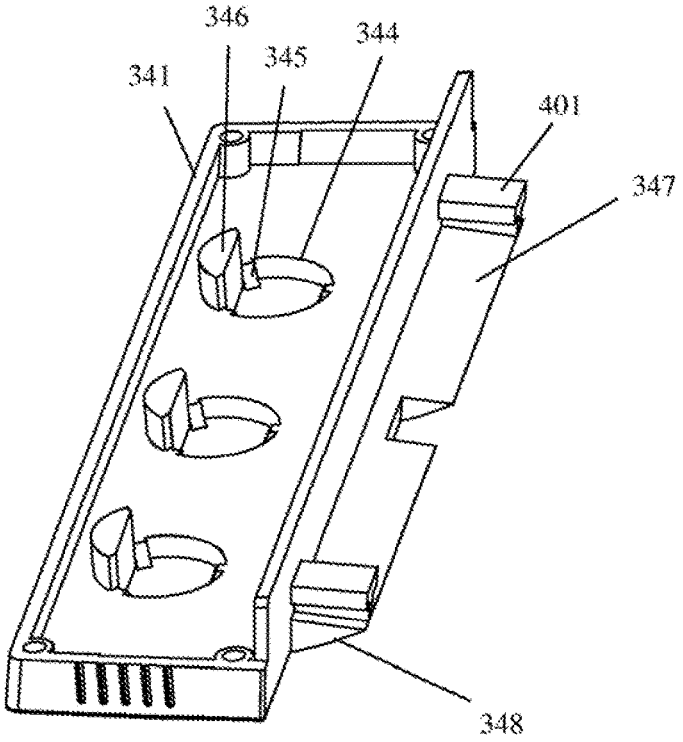
FIG. 9 is a perspective structural view of the tray cover.
Figure 10:
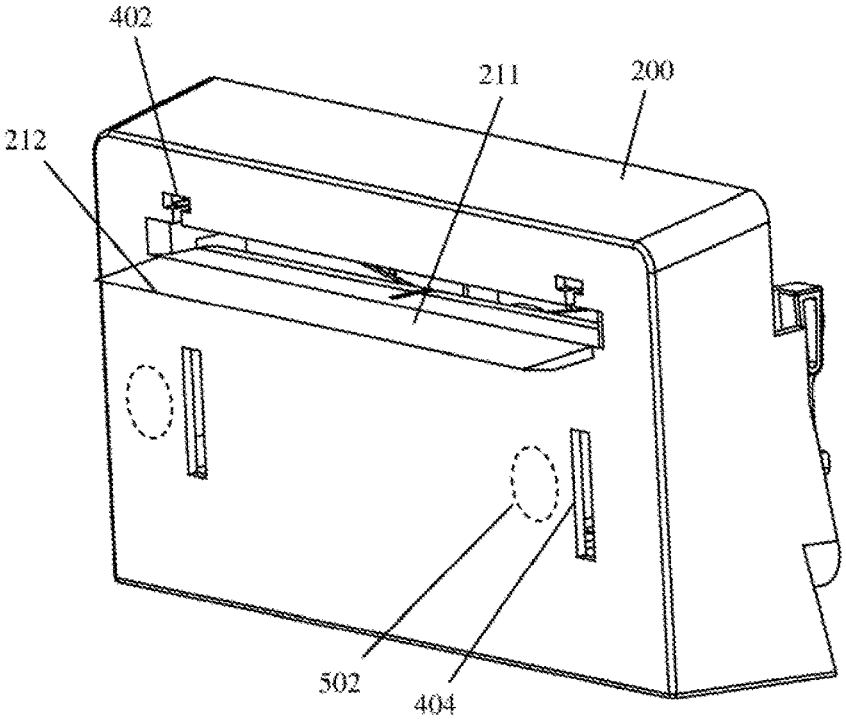
FIG. 10 shows a back side of the water application module.
Figure 11:
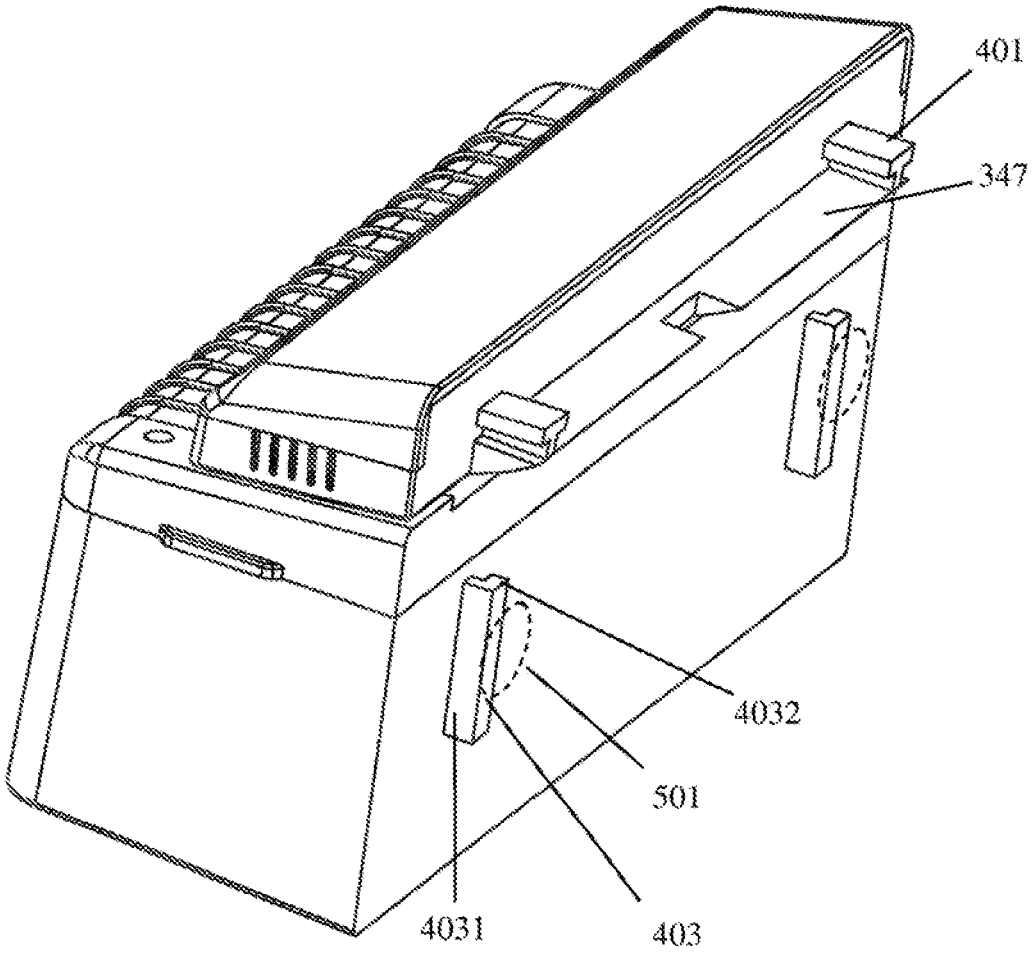
FIG. 11 shows a front side of the cutting module.

With reference to FIGS. 4, 8 and 9, the label press 302 is positioned above the water application surface 304 of the PVA water absorption sponge 303; the gap provided between the label press 302 and the water application surface 304 of the PVA water absorption sponge 303 corresponds to a label passage 210 of the cutting module 200.

The label press 302 is formed by a support tray 341, multiple roller balls 342 and a tray cover 343; multiple support holes 344 are distributed on the support tray 341 along the width direction B; each of the support holes 344 is provided with a respective roller ball 342. In the present embodiment, there are three support holes 344 and three corresponding roller balls 342. With reference to FIGS. 8-9, an inner wall of each of the support holes 344 is provided with three support legs 345 mutually spaced with respect to one another; when a roller ball 342 is positioned in a corresponding support hole 344, the roller ball is supported by the support legs 345 while partially protruding downward and out of a lower surface of the support tray 341, such that when a label passes through, the roller balls may press the hydrophilic adhesive layer of the label against the water application surface for mutual contact between the hydrophilic adhesive layer and the water application surface.

Since the support tray 341 is tilted, a block panel 346 is provided at a frontal edge of each of the support holes 344 on the support tray 341 to prevent the roller balls 342 from rolling forward and out of the support holes 344.

The tray cover 343 covers the support tray 341 so that the roller balls 342 are accommodated within a space enclosed by the support tray 341 and the tray cover 343 so as to prevent the roller balls 342 from dropping off and prevent dust from entering into the support tray 341.

In order that the label will not be jammed within gaps along an advancing path of the label from the label passage 210 of the cutting module 200 to the water application surface 304, a eaves board 211 extending toward the water application surface is provided at a lower edge of the label passage 210 of the cutting module 200; a frontal edge of the eaves board 211 is provided with a blade edge 212 attaching to the upper surface of the water application surface 304 behind the roller balls 342; a guiding board 347 extending into an interior of the label passage 210 of the cutting module 200 is also provided at a rear edge of a lower surface of the support tray 341; a lower surface of the guiding board 347 is provided with a guiding surface 348 which is gradually sloped upward as its extends rearward, thereby creating a gradually narrowed down guiding entrance from the label passage 210 of the cutting module 200 to the water application surface 304 of the water application module 300.

Two T-shaped inserts 401 are provided on a rear end surface of the support tray 341 at positions above the guiding board 347; correspondingly, two T-shaped insertion slots 402 are provided at an upper edge of the label passage 210 of the cutting module 200; the T-shaped inserts 401 on the support tray 341 insert into the T-shaped insertion slots 402 of the cutting module 200 and collaborate with the guiding board 347 inserted into the label passage 210 such that the label press 302 can be stably installed on the cutting module 200.

Besides, a rear surface of the water trough 310 is provided with two elongated L-shaped inserts 403 extending along a vertical direction; each of the L-shaped inserts 403 is formed by a root portion 4031 and a locking portion 4032; the two elongated L-shaped inserts 403 face toward a same direction.

Two elongated insertion slots 404 corresponding to the two elongated L-shaped inserts 403 and extending along a vertical direction are provided on a front surface of the cutting module 200 below the label passage 210; each of the elongated insertion slots 404 has a width just enough for insertion of a corresponding elongated L-shaped insert 403; two pairs of magnetic components are also provided; in each pair, a first magnetic component 501 of the magnetic components is embedded inside the rear surface of the water trough 310 next to the locking portion 4032 of a corresponding elongated L-shaped insert 403, a second magnetic component 502 of the magnetic components is embedded inside the front surface of the cutting module 200 next to a side of a corresponding elongated slot 404 that corresponds to the corresponding locking portion 4032. Therefore, due to the magnetic attraction between each pair of magnetic components, when the elongated L-shaped inserts 403 are inserted into the elongated insertion slots 404, the elongated L-shaped inserts 403 will cause the water application module 300 to move automatically toward a direction which the locking portions face, so that the locking portions can lock on edges of the elongated insertion slots 404 to securely connect the water application module 300 with the cutting module 200. The above structure facilitates the assembly and disassembly of the water application module 300 and the cutting module 200. Said magnetic components are magnets.

As shown in FIGS. 2-3, a top corner of a front part of the upper cover plate 330 is provided with a water inlet hole 600 to facilitate inlet of water, the water inlet hole 600 correspond to the gap 313 between edges of the lower cover plate 320 and peripheral edges of the opening 311 of the water trough 310. Therefore, when there is no water in the water trough, the water trough can be filled with water conveniently through the water inlet hole 600.

In order to observe the change of water level in the water trough, a side surface of the water trough 310 can be a transparent window. The entire water trough may also be made of transparent material.

The printing module is a prior art label printer capable of printing texts and graphics on an upper surface of a linerless label.

With reference to FIG. 4, the cutting module is also a prior art motor driven cutting machine inside which a motor driven cutter 220 is provided. An upper part of the cutting module 200 is provided with the label passage 210 for labels to pass through. A position sensor 230 is also provided inside the label passage 210.

A linerless label printer which does not require additional active force to apply water to the label according to the present invention is disclosed above. The present invention operates as follows:

A roll of linerless labels is subject to printing process in the printing module 100 so that the front surfaces of the labels are printed with texts and graphics. Next, the roll of linerless labels is transmitted to the label passage 210 of the cutting module 200; when a portion of the roll of linerless labels reaches a predetermined position and being detected by the position sensor 230 positioned in the label passage 210, the cutting module 200 will cut that portion that reaches the predetermined position as a single label. By this moment, a portion of the single label should have already passed over the water application surface 304 of the PVA water absorption sponge 303 of the water application module; as said portion of the single label passes over the water application surface 304, the hydrophilic adhesive layer at a back side of said portion should have been wetted by the water application surface 340 under the pressing force of the label press and therefore become adhesive. After that, when a user manually pulls out the cut single label, the rest of the single label will also pass over the water application surface 340 of the PVA water absorption sponge 303 and the hydrophilic adhesive layer at a back side of the rest of the single label will also be wetted by the water application surface 340 under the pressing force of the label press and therefore become adhesive. The single label subjected to water application treatment can therefore be directly adhered to a surface of an object that requires such label.

It can be seen that the present invention achieves automatic cutting and water application of a linerless label after the label is printed with texts and graphics. Therefore the present invention integrates the functions of printing, water application and cutting, thereby facilitating the use of linerless label across a wide range of applications. Compared with the prior art, the present invention does not require additional active force to achieve automatic water application by water application components, thereby simplifying the structure of the printer and reducing the costs of the printer.

Embodiment 2

Figure 12:
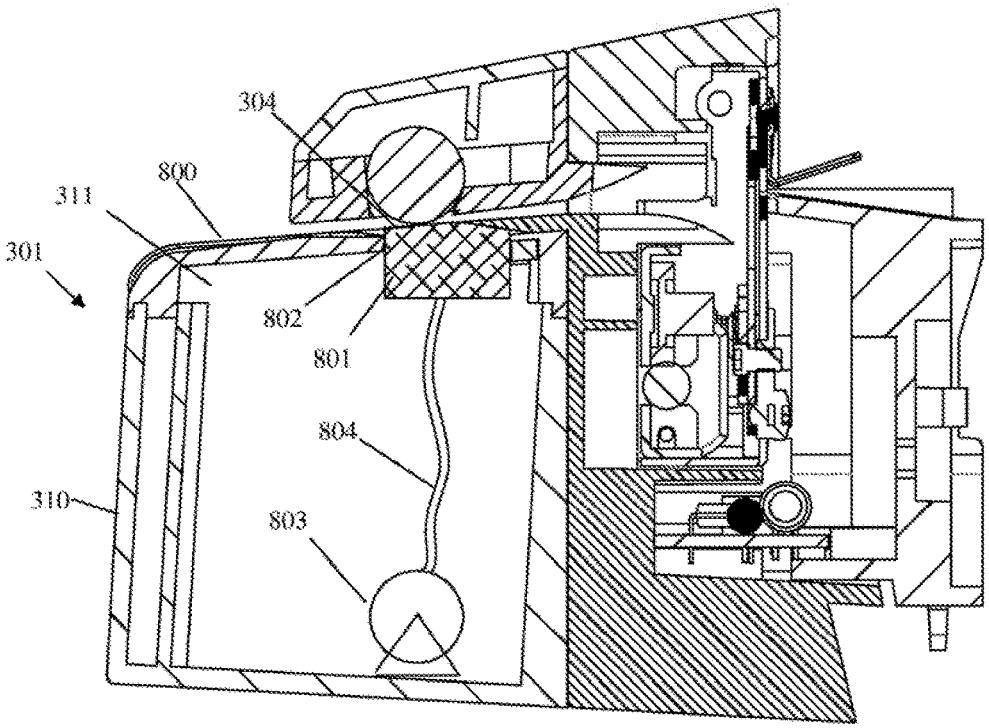
FIG. 12 is a sectional view showing the internal structure of the present invention according to embodiment 2, with the printing module omitted.

As shown in FIG. 12, embodiment 2 has the following differences compared with embodiment 1: the PVA water absorption sponge is made as a block, therefore being a PVA water absorption sponge block 801.

The shell 301 is formed by the water trough 310 and a cover plate 800.

The upper part of the water trough 310 has the opening 311. The cover plate 800 directly covers the opening 311 of the water trough 310. An accommodation window 802 for accommodating the PVA water absorption sponge block 801 is provided on the cover plate 800. An upper surface of the PVA water absorption sponge block 801 is also slightly higher than the upper surface of the cover plate 800 by 0.5 mm to form the water application surface 304. The bottom part of the water trough 311 is provided with a mini water pump 803; the water pump 803 is connected to the PVA water absorption sponge block 801 via a pipe 804. Also, the water pump 803 is connected with a power supply circuit of the printing module via a power line to obtain the power supply required for operation.

In this embodiment, the PVA water absorption sponge block 801 is supplied with water via the water pump 803. To facilitate inlet of water, a water inlet hole in communication with the water trough 310 is provided on the cover plate 800.

The remaining structures of embodiment 2 are the same as those of embodiment 1 and therefore will not be repeatedly described here.

Embodiment 3

Figure 13:
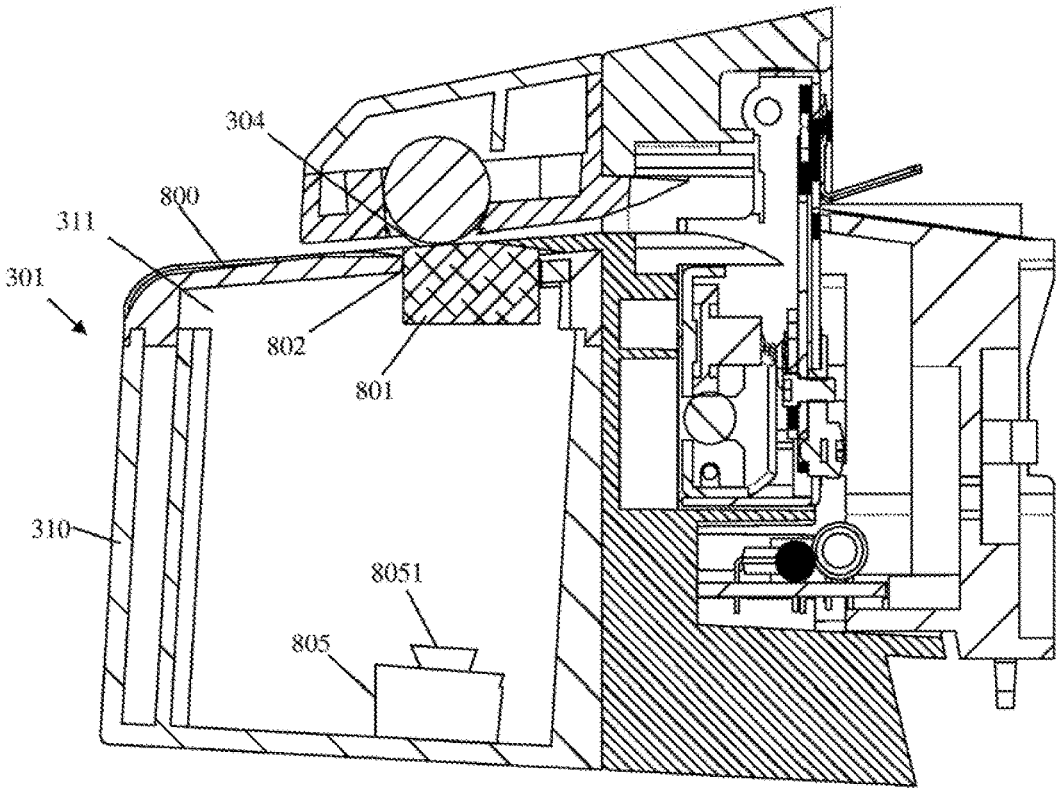
FIG. 13 is a sectional view showing the internal structure of the present invention according to embodiment 3, with the printing module omitted.

As shown in FIG. 13, embodiment 3 has the following differences compared with embodiment 1: the PVA water absorption sponge is made in a block shape, therefore being a PVA water absorption sponge block 801.

The shell 301 is formed by the water trough 310 and the cover plate 800.

The upper part of the water trough 310 is provided with the opening 311. The cover plate directly covers the opening 311 of the water trough 311. An accommodation window 802 for accommodating the PVA water absorption sponge block 801 is provided on the cover plate 800. An upper surface of the PVA water absorption sponge block 801 is also slightly higher than an upper surface of the cover plate by 0.5 mm to form the water application surface 304. The bottom part of the water trough 311 is provided with an ultrasonic mist dispenser 805. A nozzle 8051 of the ultrasonic mist dispenser 805 faces the PVA water absorption sponge block 801. The ultrasonic mist dispenser 805 is connected with a power supply circuit of the printing module via a power line to obtain the power supply required for operation.

In this embodiment, the ultrasonic mist dispenser 805 may vaporize the water into small water droplets and spray the small water droplets on the PVA water absorption sponge block 801 to supply the PVA water absorption sponge block with water.

The remaining structures of embodiment 3 are the same as those of embodiment 1 and therefore will not be repeatedly described here.

The PVA water absorption sponge in all the above described embodiments is the PVA water absorption sponge of model No. 306C manufactured by Shanghai Ruijing Dust free Technology Company Limited. The PVA water absorption sponge as used has the following specifications:

| | |
|---|---|
| Pore diameter | 60-2000 μm |
| Pore distribution rate | 88-94% |
| Amount of absorbable liquid | 900-1500% of its own weight |
| Tensile strength | 2-6 kg/cm$^2$ |
| Tensile length | 100-300% |

Under a testing condition in which the roll of labels rolls out by 10 m per minute, the amount of water applied to a label by using the above PVA water absorption sponge is just right enough to ensure that the hydrophilic adhesive layer at the back of the label is completely activated so that the hydrophilic adhesive layer can possess sufficient adhesiveness to adhere firmly on a surface of an object, and water will not permeate the entire label so that the front surface of the label remains dry, thereby maintaining the label and the contents printed on the front surface of the label intact and undamaged.

As seen from above, due to good water absorption property and good water conductivity of the PVA water absorption sponge, the use of the PVA water absorption sponge directly as a water application piece allows simple structure and easy installation of the printer as well as stable water application performance.

A person skilled in this field of art should understand that the embodiments described above are intended only for explaining the present invention instead of limiting the present invention. Any changes and modifications of the above described embodiments made within the inventive concept of the present invention should fall within the scope of the claims of the present invention.

What is claimed is:

1. A linerless label printer, comprising a printing module; a cutting module and a water application module are sequentially arranged wherein the cutting module is provided in front of the printing module, and the water application module is provided in front of the cutting module; the water application module comprises a shell for storing water, a water application piece fixed on the shell and capable of obtaining water in the shell to maintain moisture; the water application piece comprises a water application surface exposed out of an upper surface of the shell; a label press is provided above the water application surface of the water application piece; the linerless label printer is characterized in that, the water application piece is a polyvinyl alcohol (PVA) water absorption sponge; the PVA water absorption sponge is made in a sheet shape; at least one end of the PVA water absorption sponge extends downward till a bottom part of a water trough provided inside the shell; the shell has the water trough provided inside the shell; an upper part of the water trough is provided with an opening; the shell also comprises a lower cover plate at the opening of the water trough, and an upper cover plate above the lower cover plate; the lower cover plate is provided two slots parallel with each other; in between the two slots, a support plate is provided; two ends of the PVA water absorption sponge are inserted into the water trough through the two slots respectively such that the support plate supports the PVA water absorption sponge; a window is provided on the upper cover plate at a position corresponding to the support plate; an upper surface of a portion of the PVA water absorption sponge supported by the support plate forms the water application surface; the water application surface is positioned in the window, and is slightly higher than an upper surface of the upper cover plate.

2. The linerless label printer according to claim 1, wherein ribs mutually spaced with respect to one another are distributed on the upper surface of the upper cover plate in front of the window; the ribs extend toward a direction consistent with a moving direction of a linerless label.

3. The linerless label printer according to claim 1, wherein the label press is formed by a support tray and multiple roller balls; a gap is provided between a lower surface of the support tray and the water application surface of the water application piece; support legs mutually spaced with respect to one another are provided on the support tray to support the roller balls while allowing the roller balls to partially protrude downward and out of a lower surface of the support tray, such that when a linerless label passes through the gap, the roller balls press a hydrophilic adhesive layer of the linerless label against the water application surface for mutual contact between the hydrophilic adhesive layer and the water application surface.

4. The linerless label printer according to claim 3, wherein a tray cover is provided on the support tray.

5. The linerless label printer according to claim 3, wherein an eaves hoard is extended out of a lower edge of a label passage of the cutting module; a frontal edge of the eaves board is provided with a blade edge attaching to the water application surface behind the roller balls; a guiding surface extending into an interior of the label passage of the cutting module and tilting upward is also provided at a rear edge of a lower surface of the support tray; the guiding surface and the eaves board form a gradually narrowed down guiding entrance from the label passage to the water application surface.

6. The linerless label printer according to claim 1, wherein a rear surface of the water application module is provided with at least two elongated L-shaped inserts extending along a vertical direction; each of the L-shaped inserts is formed by a root portion and a locking portion; the two elongated L-shaped inserts face toward a same direction; elongated insertion slots for insertion by the elongated L-shaped inserts are provided on a front surface of the cutting module; at least one pair of magnetic components are also provided; in each pair of magnetic components, a first magnetic component of the magnetic components is embedded inside the rear surface of the water application module next to the locking portion of a corresponding elongated L-shaped insert, a second magnetic component of the magnetic components is embedded inside the front surface of the cutting module next to a side of a corresponding elongated slot that corresponds to the corresponding locking portion.

7. The linerless label printer according to claim 1, wherein the PVA water absorption sponge is made as a block; a bottom part of the shell comprises a water pump; the water pump and the PVA water absorption sponge are connected via a pipe.

8. The linerless label printer according to claim 1, wherein the PVA water absorption sponge is made as a block; a bottom part of the shell is provided with a mist dispenser which has a nozzle facing toward the PVA water absorption sponge.

* * * * *